United States Patent [19]

McDermott

[11] Patent Number: 4,991,875

[45] Date of Patent: Feb. 12, 1991

[54] SKI POLE MOUNTED WINDSCREEN

[76] Inventor: James W. McDermott, Rte. 6, Box 1224, Ellensburg, Wash. 98929

[21] Appl. No.: 430,575

[22] Filed: Nov. 1, 1989

[51] Int. Cl.[5] ..... A63C 11/22

[52] U.S. Cl. ..... 280/816; 280/819; 280/820; 294/147

[58] Field of Search ..... 280/809, 810, 812, 814, 280/816, 819, 820; 135/66; 114/361; 294/147; 296/78.1, 85

[56] References Cited

U.S. PATENT DOCUMENTS

| | | | |
|---|---|---|---|
| 418,806 | 1/1890 | Minniss | 135/66 |
| 1,618,065 | 2/1927 | Davis | 135/66 X |
| 1,843,874 | 2/1932 | Hulst | 114/361 |
| 3,370,818 | 2/1968 | Perr | 248/205.2 |
| 4,065,140 | 12/1977 | Cadwalader | 135/66 X |
| 4,214,770 | 7/1980 | Agins | 280/819 |
| 4,531,763 | 7/1985 | Toland | 280/810 |
| 4,674,787 | 6/1987 | DeVera | 280/814 X |
| 4,756,555 | 7/1988 | Bachmann | 280/810 |
| 4,813,369 | 3/1989 | Moreland | 24/442 X |
| 4,850,383 | 7/1989 | McBride | 135/66 |

FOREIGN PATENT DOCUMENTS

| | | | |
|---|---|---|---|
| 88683 | 11/1921 | Austria | 135/66 |
| 169440 | 11/1951 | Austria | 280/810 |
| 1383879 | 11/1964 | France | 280/812 |
| 185703 | 10/1936 | Switzerland . | |

OTHER PUBLICATIONS

Popular Mechanics "Austrian's Ski Sail Permits Long Leaps", Jan. 1953, p. 155.

Der Schwebelauf by Prof. Dr. Hans Thirring Copyright 1939, p. 88a.

*Primary Examiner*—Charles A. Marmor

*Assistant Examiner*—Brian L. Johnson

*Attorney, Agent, or Firm*—Wells, St. John & Roberts

[57] ABSTRACT

A windscreen is described that is selectively mountable to snow ski poles for use by the skier as a screen against the elements when riding on a ski chair lift. The windscreen sheet is also flexible and may be rolled to a storage condition about one of the ski poles. Fasteners are provided to selectively secure the sheet to the ski poles such that the skier may hold the screen in an expanded, operative orientation. The fasteners may also be released to facilitate rolling of the sheet onto one of the poles and securing the rolled sheet in position on the pole for storage and transport on the downhill run. The fasteners are further provided to selectively secure the sheet to the poles against axial motion thereon.

15 Claims, 4 Drawing Sheets

SKI POLE MOUNTED WINDSCREEN

TECHNICAL FIELD

The present invention relates to protective windscreen apparatus for snow skiers, and particularly to a windscreen for use in conjunction with ski poles for protecting skiers riding on exposed chair lifts.

BACKGROUND OF THE INVENTION

In the sport of recreational skiing, a need has been long felt for sheltering skiers on chair lifts. On a windy, snowy day the chair lift ride is a source of discomfort to many skiers. Various clothing accessories are available to protect the chair rider, but such bulky clothing is often an inconvenience on the downhill run. For example, the face mask protects nicely on the chair and is practical on a severely cold day. But on a normal, windy, snow-pelty day, it causes overheating and is annoying. The long felt need has therefore remained for some form of device that would protect the skier on a chair lift but which would not hamper the skier on the downhill run.

Various chair lift manufacturers have considered the problem and have provided windscreens on the chair lift frames. Others have enclosed lifts. However, the bulk of ski areas still utilize open chair lifts that expose skiers directly to the elements.

The present invention was conceived as an answer to this need in the form of a portable windscreen that is waterproof, windproof, may be easily erected, and that maybe handily stored without interfering or obstructing the skier during the downhill run. Thus, it is an objective of the present invention to provide a windscreen that may be selectively carried by the skier and used at the skier's discretion on ordinary chair lifts to protect or screen against the weather. It is a further object to provide such a device that may be easily transported and stored so as not to obstruct the skier during the downhill run, ye which may be easily accessed by the skier for the ride back up the hill. A still further object is to provide such an apparatus that is extremely simple to operate and may be quickly shifted between an extended, operative windscreening orientation and a stored, out-of-the-way condition. The above and still further objects and advantages will be become apparent upon reading the following description which, taken with the accompanying drawings, disclose a preferred example of the present invention.

BRIEF DESCRIPTION OF THE DRAWINGS

A preferred form of the present invention is exemplified in the drawings, in which.

DETAILED DESCRIPTION OF A PREFERRED EMBODIMENTS

The following disclosure of the invention is submitted in furtherance with the constitutional purpose of the Patent Laws "to promote the progress of science and useful arts" (Article 1, Section 8).

Figures 1, 2, 3:
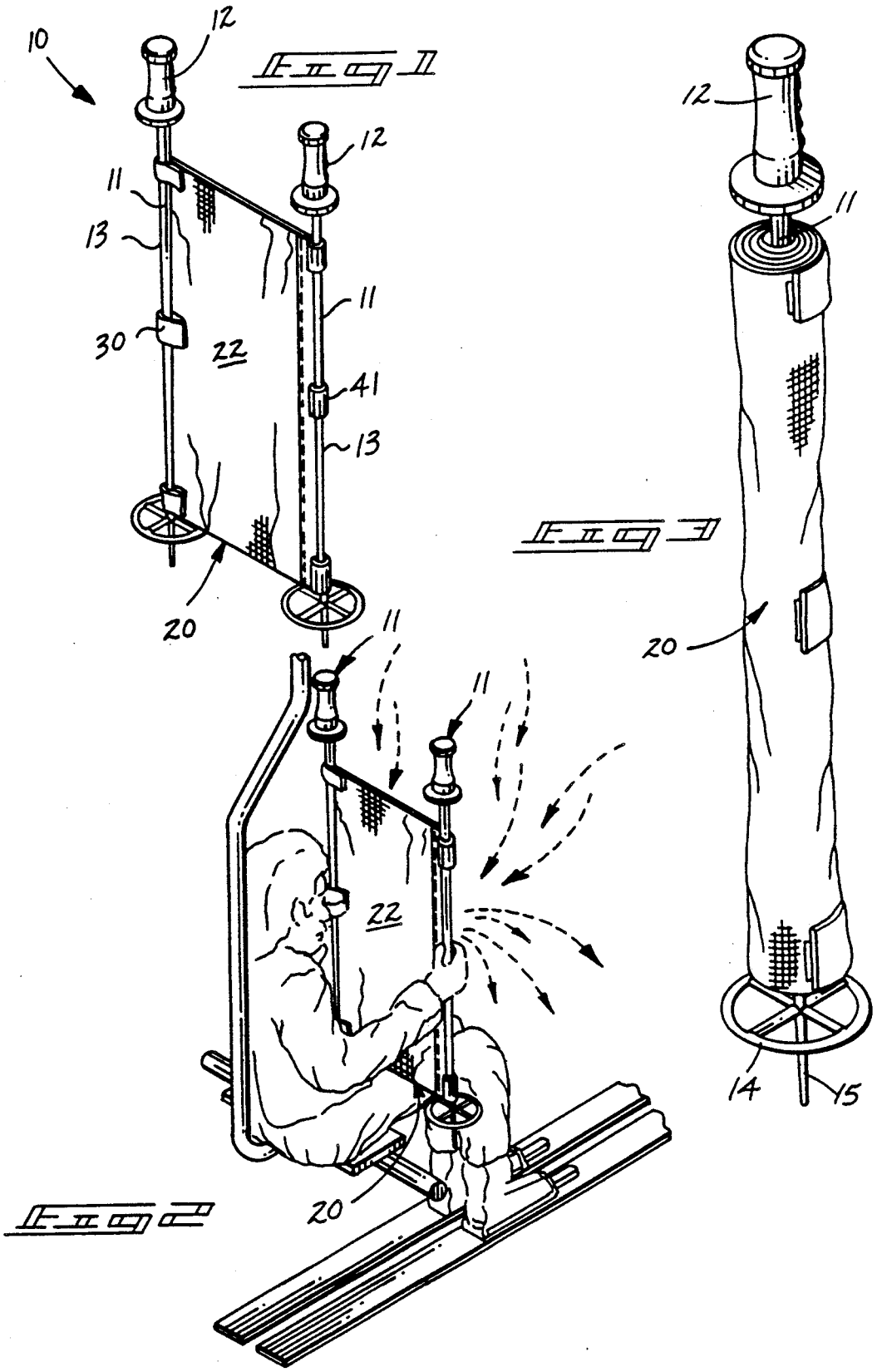
FIG. 1 is a pictorial view of the present windscreen in an expanded, operative condition between a pair of ski poles.
FIG. 2 is a illustrative view of a skier on a chair lift using the present windscreen.
FIG. 3 is a pictorial view of the present screen in an inoperative storage condition in relation to a ski pole.

A preferred form of the present invention is exemplified in the drawings and is generally designated therein by the reference numeral 10. The present windscreen 10 is intended to be attached to existing forms of ski poles 11. The windscreen, attached to the poles 11 may be effectively held and oriented by a rider on a ski chair lift such as illustrated in FIG. 2 for the purpose of deflecting wind, rain, snow, etc. during the ride up a ski hill. When not in use, the windscreen 10 may be carried in a rolled, storage condition as shown in FIG. 3.

The ski poles 11 may be any of a number of conventional forms, including handles 12 at upward ends and elongated tapering shafts 13 extending to bales 14 and tips 15 at lower ends. It is preferred that the ski poles 11 include relatively straight shafts 13 for best results with the present windscreen 10.

The windscreen 10 is comprised of a flexible sheet 20 of, preferably, waterproof, lightweight material such as treated nylon or other appropriate thin, flexible yet weatherproof material. Physically, the sheet includes a forward surface 21 and an opposed rearward surface 22. The surfaces 21, 22 are referred to as forward and rearward surfaces simply for purposes of further description. In fact, either surface may be used as a forwardly projecting surface by the skier.

The sheet 20 also includes a first longitudinal edge 23 and an opposed, second longitudinal edge 24 that extend along the length dimension of the sheet between end edges. The end edges include a top edge 25 and a bottom edge 26.

It is advantageous that the sheet 20 be tapered along its length from the top edge 25 to the bottom edge 26. It is preferred that the taper be along the first longitudinal edge 23, extending from the top to the bottom. The preferred taper is such that the top edge 25 is of greater dimension along its length than the bottom edge 26. The taper is set according to the corresponding taper of the ski pole shafts 13. Using such a taper, the sheet 20 will be made to roll onto itself toward the storage condition shown in FIG. 3 with the top and bottom edges 25, 26 in substantial axial registration. The taper is thus preferred to facilitate a neat, even roll of the sheet when in its storage, inoperative condition.

A first fastener means 29 is provided on the sheet for fastening the first longitudinal edge 23 to one of the ski poles 13. The first fastener means 29 is also provided to secure the sheet to the ski pole in such a manner that the sheet will not move axially along the length of the shaft 13.

Figure 7:
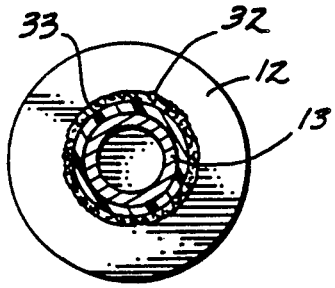
FIG. 7 is a enlarged sectional view taken substantially along line 7—7 in FIG. 4.
Figure 8B:
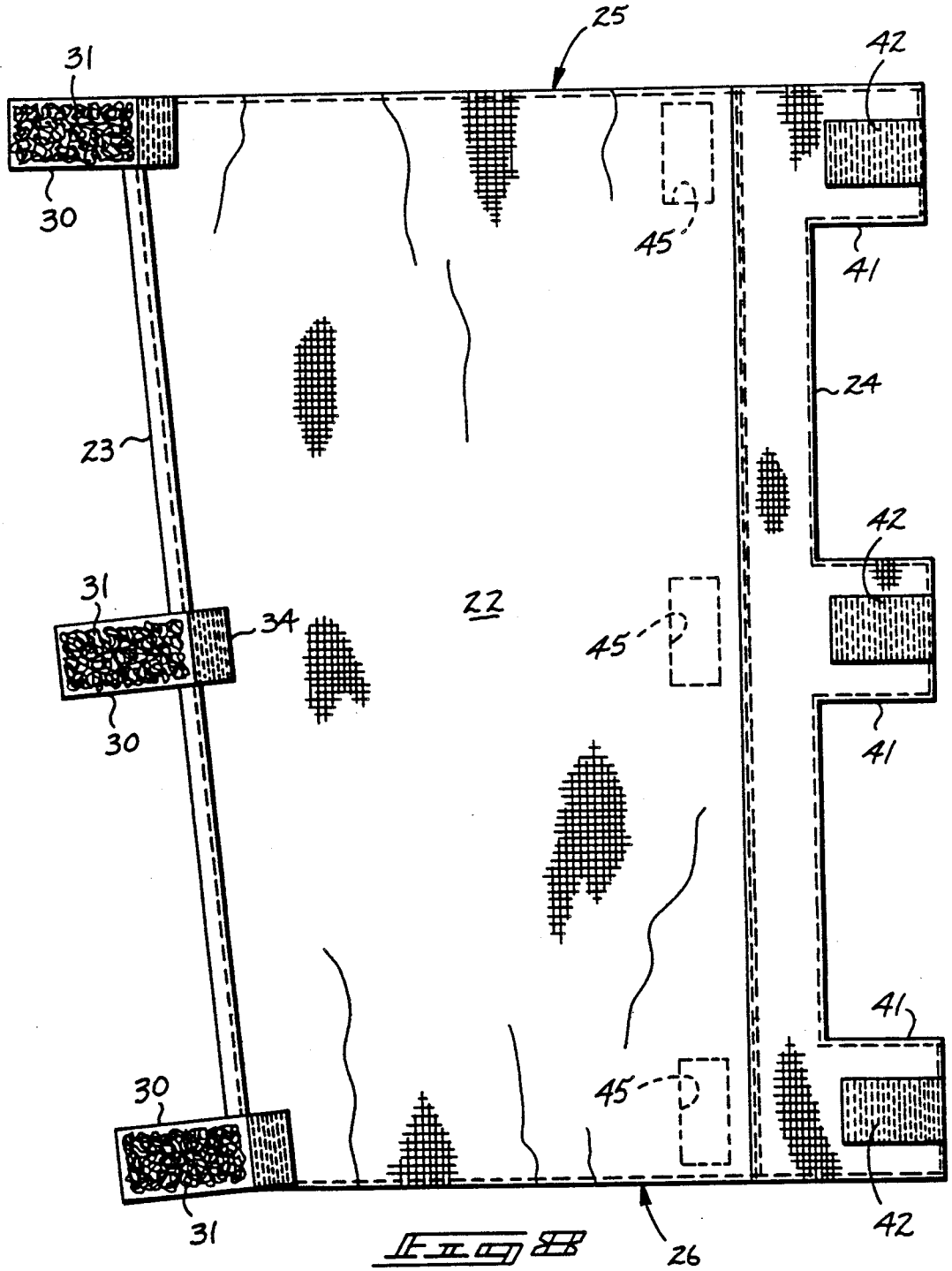
FIG. 8 is a rear elevational view of a back surface of the present preferred windscreen.

First fastener means 29 is advantageously comprised of first fastener tabs 30 that extend outwardly of the sheet along the first longitudinal edge 23. The tabs 30 include first hook-and-loop fastener members 31. First securing means in the form of first mating hook-and-loop fastener members 32 are provided and are adapted for attachment to the ski pole shaft 13. This may be done by adhesive, 33 (FIG. 7). The mating hook-and-loop fastener members 32 are positioned along the length of the shaft to receive and become attached to the first fastener members 31.

Each member 32 extends substantially about the circumference of the shaft 13. The fastener members 31 are of sufficient length to extend about the shaft to engage and become attached to the mating hook-and-loop fastener elements of the mating members 32. This secures the first edge to the ski pole shaft 13 and prevents axial motion of the sheet along the length of the shaft.

Preferably, the first fastener members are also of sufficient length to engage and become attached to auxiliary mating hook-and-loop members 34 that are attached to the sheet 20 slightly inward of the first longitudinal edge 23. Members 34 align with the first hook-and-loop fastener members 31.

The auxiliary mating hook-and-loop members 34 will thus receive and engage the fist hook-and-loop members 31 with such members 31 also extending about the first mating hook-and-loop fastener members 32. This condition is illustrating in FIGS. 1 and 2 which show the overlap of the first tabs 30 onto the sheet, wit the tabs being folded over and partially encircling the mating members 32 on the associated ski pole 13. The auxiliary hook-and-loop members 34 provide additional connector surface for the first fastener means 29 in order to securely, yet removably mount the first sheet edge 23 to the ski pole.

A second fastener means 40 is provided along the second longitudinal edge 24 for selectively securing the edge 24 to the remaining ski pole 11. The second fastener means 40 is also utilized to secure the second longitudinal edge to the one ski pole shaft when the sheet is in its rolled, storage condition (FIG. 3). The second fastener means thus has dual function in assisting connection of the present sheet 20 to the ski poles in the operative condition shown in FIGS. 1 and 2 and for securing the sheet in its rolled, storage condition as shown in FIG. 3.

Figures 4, 5:
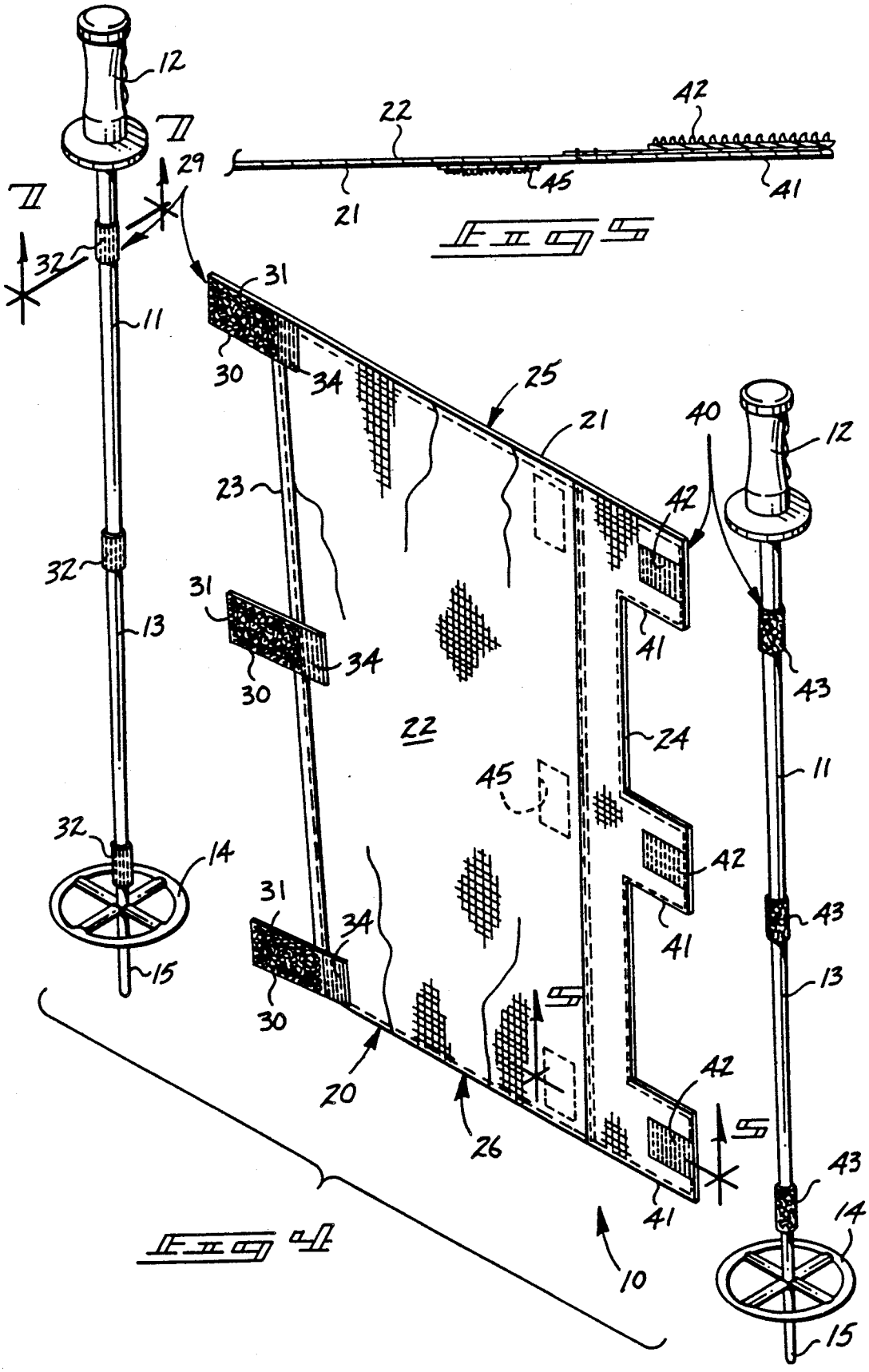
FIG. 4 is an exploded pictorial view illustrating the present preferred windscreen adjacent a pair of ski poles.
FIG. 5 is a partially enlarged section view taken substantially along line 5—5 in FIG. 4.
Figure 6:
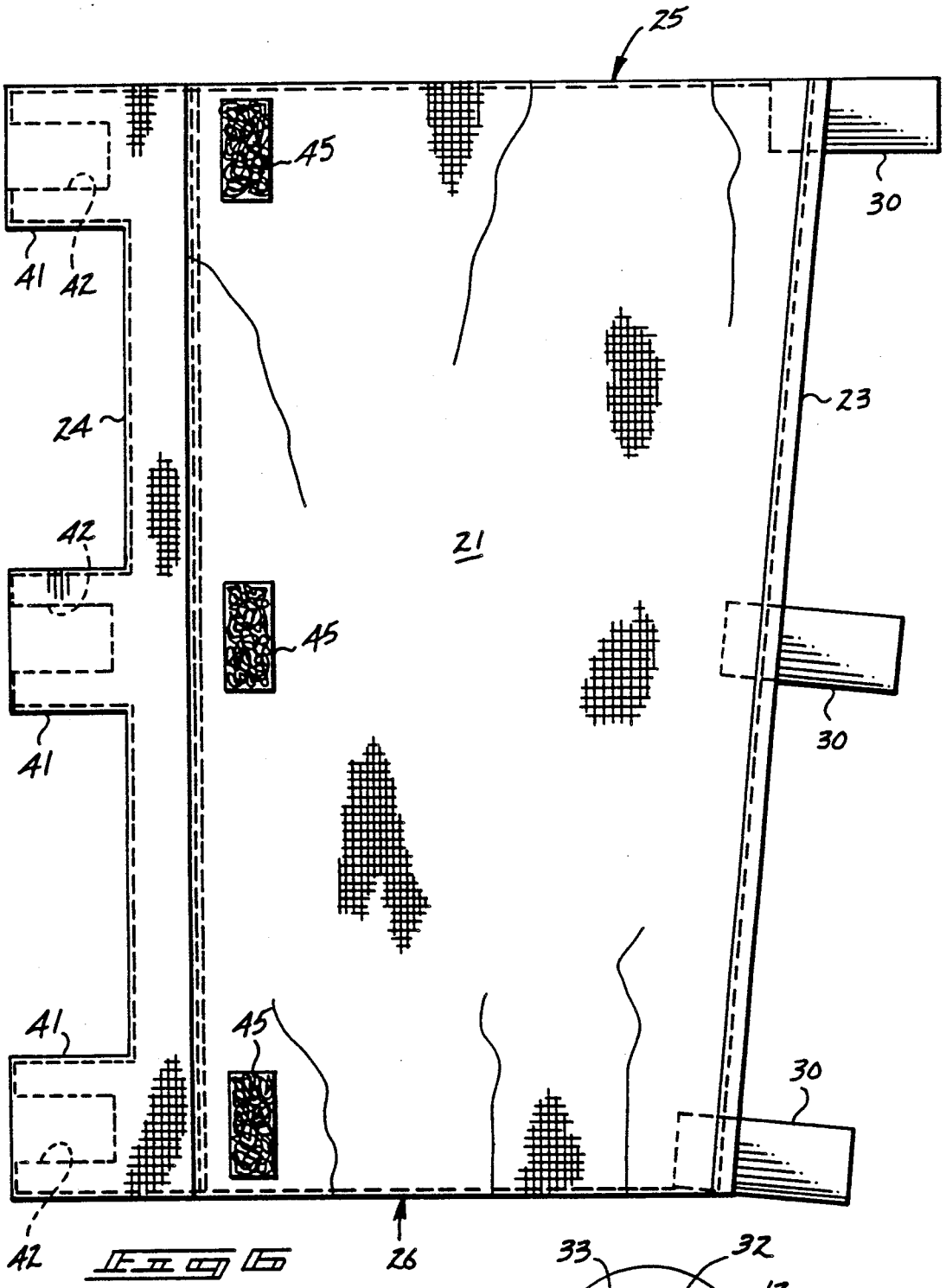
FIG. 6 is a front elevational view of a forward surface of the present preferred windscreen.

In a preferred form, the second fastener means 30 includes second fastener tabs 41 that extend outwardly from the sheet 20. The tabs 41 mount second hook-and-loop fastener members 42. It may be noted in FIGS. 4 and 6 that the tabs 41 include length and width dimensions that are somewhat greater than the corresponding dimensions of the hook-and-loop fastener members 42. Thus, the tabs 41 substantially overlap the dimension of the fastener members 42. The tabs thus provide easy finger access to the user.

It may be noted at this point that the preferred sheet includes the first hook-and-loop fastener members 31, the auxiliary mating fastener members 34, and the second hook-and-loop fastener members 32 all on the rearward surface 22 of the sheet. Orientation of these various fastener members on a single side of the sheet is intended to facilitate ease of assembling the sheet itself, and is an advantage to the skier in attaching and removing the windscreen for the ski poles.

The second fastener means 40 further comprises second securing means in the form of mating hook-and-loop fastener members 43 that are selectively attached to the remaining ski pole shaft 13. The mating fastener members 43 may be substantially identical to the first mating fastener members 32 and are attached in the same manner to the remaining ski pole 11. Mating members 43 are positioned along the remaining pole shaft 13 to selectively engage and secure the second fastener members 42 as the second fastener members wrap about the second mating members in a manner as substantially shown in FIGS. 1 and 2 of the drawings.

The portions of the second fastener means 40 described to this point are utilized to accomplish the first function of the second fastener means, to selectively secure the second longitudinal edge to the remaining ski pole 11 of the pair. To accomplish the second function, third fastener members 45 are provided on the forward surface 21 of the sheet. The third fastener members are hook-and-loop fastener members positioned along the sheet inward of the second edge 24 and in alignment with the second hook-and-loop fastener members 42. The third members 45 are positioned to secure the second fastener members 42 in position and thereby secure the sheet in the furled, storage condition shown in FIG. 3. Thus, the sheet is rolled onto itself such that the third fastener members 45 are exposed outwardly for mating engagement with the second hook-and-loop fastener members 42.

It is pointed out that the first and second fastener means 29, 40 include a series of three tabs on each longitudinal side of the sheet. Tabs extend from top and bottom edges of the sheet with a third tab situated substantially centrally between the top and bottom tabs. Other arrangements could also be utilized. However, this is preferred as the three tabs on opposite side edges facilitate mounting of the sheet to the pole and secure the sheet axially against slipping during use.

Use of the present invention may begin following a very simple and quick assembly in which the mating hook-and-loop fastener members 32, 43, are attached to the ski pole shaft 13. This is done simply by laying the ski poles alongside the open sheet to determine the location of the tabs 30 and 41.

The mating fastener members 32, 43 may then be secured in similar positions along the ski poles by the adhesive 33. For example, if tape is employed as the adhesive 33, the members 32, 43 may be supplied with removable backing strips (not shown). The backing strip may be conveniently removed to expose the adhesive for contact with the ski pole shafts 13.

Once the mating fastener members 32, 43 are secured to the shafts 13, the sheet can be selectively mounted and dismounted to the poles 11. The sheet thus mounted may be held either in the operative position shown in FIGS. 1 and 2, or the storage, rolled position shown in FIG. 3.

The user attaches the sheet simply by securing the first hook-and-loop fastener members 31 to the first mating members 32 on the appropriate ski pole. The second hook-and-loop fastener members 42 are likewise secured to the second mating fastener members 43. The sheet now extends between the poles and can be held in a protective orientation as desired by the skier.

An exemplary position is illustrated in FIG. 2 in which wind, snow, etc. may be coming from a direction facing the skier. It can be seen that the sheet will protect the skier against the elements by acting as an abutment surface ahead of the skier's face and torso. Of course, the sheet can be positioned at other various angles to deflect wind, snow, etc.

Near the top of the hill, the skier may wish to roll the sheet to the storage position. This is done simply by pulling the overlapped second tabs 41 away form the second mating members 43 to disengage the sheet from the associated ski pole. This frees the second edge and allows the skier to roll the sheet onto the one ski pole to the condition shown in FIG. 3. The second hook-and-loop fastener members 43 may then be easily secured to the third fastener members 45, securing the sheet in the rolled, storage condition. The sheet can now be easily transported along the downhill run by the skier without the sheet interfering in any substantial manner with the skier's comfort.

In compliance with the statute, the invention has been described in language more or less specific as to structural features. It is to be understood, however, that the invention is not limited to the specific features shown, since the means and construction herein disclosed comprise a preferred form of making and using the invention. The invention is, therefore, claimed in any of its forms or modifications within the proper scope f the appended claims appropriately interpreted in accordance with the doctrine of equivalents.

I claim:

1. A ski pole mounted windscreen to be mounted between a pair of elongated ski pole shafts and dimensioned to shield the head and torso of a user riding on a ski chair lift, comprising:

a sheet of flexible material having opposed first and second longitudinal edges jointed by transverse end edges;

the end edges being spaced apart by a distance approximately equal to the seated height of the user's head and torso;

the first and second longitudinal edges being spaced apart by a distance approximately equal to the width between a user's shoulders;

first fastener means along the first longitudinal edge for fastening the first longitudinal edge to a first securing means fixed on a first ski pole shaft and for securing the first longitudinal edge to the first ski pole shaft against longitudinal movement thereon;

said sheet being sufficiently flexible to be rolled onto itself from an unrolled operative condition, to a rolled storage condition around the first ski pole;

a second fastener means along the second longitudinal edge for selectively securing the second longitudinal edge to a second securing means fixed on a second ski pole against longitudinal movement thereon with the sheet in said operative condition, and for selectively securing the second longitudinal edge to the first ski pole shaft with the sheet in said rolled storage condition; and wherein the sheet dimensions and the first and second fastener means are positioned in relation to one another and to the ski poles to enable a user, while seated on a chair lift to: (a) unroll the sheet from the rolled storage condition around the first ski pole, (b) connect the second fastener means to the second ski pole, (c) grasp the first and second ski poles and hold them in front of the torso with the sheet spanning the torso laterally across the shoulders and longitudinally along the torso and head for protection against climatic elements, (d) to subsequently disconnect the second fastener means from the second ski pole, (e) roll the sheet back onto the first ski pole shaft to the rolled storage condition, and (f) fasten the second fastener means to a third fastener means to maintain the sheet in the rolled storage condition.

2. The ski pole mounted windscreen of claim 1 wherein the sheet is tapered along a longitudinal edge.

3. The ski pole mounted windscreen of claim 1 wherein the first fastener means is comprised of:

first fastener tabs extending outward of the sheet;

a first hook and loop fastener member on the first fastener tabs, extending from the longitudinal edge by a distance sufficient to at least partially encircle the ski pole shaft; and said first securing means including a first mating hook and loop fastener member to be secured to the ski pole shaft and selectively engagable with the first hook and loop fastener member to secure the first longitudinal edge to the first pole shaft.

4. The ski pole mounted windscreen of claim 3 further comprising an auxiliary mating hook and loop fastener member on the sheet adjacent to and engagable with the first hook and loop fastener member, with said first fastener tab extending about the first ski pole shaft.

5. The ski pole mounted windscreen of claim 1 wherein the second fastener means is comprised of:

second fastener tabs extending outwardly from the sheet;

second hook and loop fastener members on the second fastener tabs; and said second securing means including a second mating hook and loop fastener members to be secured to the second ski pole shaft and selectively engagable with the second hook and loop fastener members to secure the second longitudinal edge to the second ski pole shaft.

6. The ski pole mounted windscreen of claim 5 wherein the third fastener means is further comprised of:

third fastener members on the sheet and positioned thereon for engagement with the second hook and loop fastener members, with the sheet in said rolled storage condition.

7. The ski pole mounted windscreen of claim 6 wherein the first fastener means is comprised of:

a first hook and loop fastener tab on the first longitudinal edge, extending from the longitudinal edge by a distance sufficient to at least partially encircle the first ski pole shaft; and said first securing means including a first mating hook and loop fastener member to be secured to the first ski pole shaft and selectively engagable with the first hook and loop fastener tab to secure the first longitudinal edge to the first ski pole shaft.

8. The ski pole mounted windscreen of claim 7 further comprising an auxiliary mating fastener member on the sheet adjacent the first hook and loop fastener tab, engagable with the first hook and loop fastener tab with said tab extending about the first ski pole shaft.

9. The ski pole mounted windscreen of claim 8 wherein the sheet includes a forward surface and an opposed rearward surface:

wherein the first hook an loop fastener members, the second fastener members, and the auxiliary mating fastener members are situated on the forward surface; and wherein the third fastener members are located on the rearward surface.

10. The ski pole mounted windscreen of claim 9 wherein the second fastener tabs include length and width dimensions that are greater than corresponding length and width dimensions of the second hook and loop fastener members.

11. The ski pole mounted windscreen of claim 10 wherein the sheet includes a top edge and a bottom edge and wherein the first and second fastener tabs extend outwardly of the longitudinal edges at the top and bottom sheet edges.

12. The ski pole mounted windscreen of claim 10 wherein the sheet includes a top edge and a bottom edge and wherein the first and second fastener tabs extend outwardly of the longitudinal edges at the top and bottom sheet edges, and from central locations along the longitudinal edges between the top and bottom edges.

13. The ski pole mounted windscreen of claim 1 wherein the sheet includes a top edge and a bottom edge extending between the longitudinal edges and wherein the sheet is tapered such that the top edge is longer than the bottom edge.

14. The ski pole mounted windscreen of claim 1 wherein the first fastener means is comprised of:

first fastener tabs projecting outwardly of the sheet;

first hook and loop fastener members on the first fastener tabs, each extending from the first longitudinal edge by a distance sufficient to at least partially encircle the first ski pole shaft; and first mating hook and loop fastener members in the form of strips of hook and loop fastener material adhered to and extending about the first ski pole shaft for releasably receiving and holding the first hook and loop fastener axially against the first ski pole shaft.

15. The ski pole mounted windscreen of claim 14 wherein the second fastener means is comprised of:

second fastener tabs projecting outwardly of the sheet;

second hook and loop fastener members on the second fastener tabs, each extending from the second longitudinal edge by a distance sufficient to at least partially encircle the second ski pole shaft; and second mating hook and loop fastener members in the form of strips of hook and loop fastener material adhered to and extending about the second ski pole shaft for releasably receiving and holding the second hook and loop fastener axially against the second ski pole shaft.

* * * * *